US008011515B2

(12) United States Patent
Gallagher

(10) Patent No.: US 8,011,515 B2
(45) Date of Patent: Sep. 6, 2011

(54) TWO STAGE PULP SCREENING DEVICE WITH TWO STATIONARY CYLINDRICAL SCREENS

(75) Inventor: Brian J Gallagher, Litchfield, NH (US)

(73) Assignee: Ovivo Luxembourg S.á.r.l., Munsbach (LU)

( * ) Notice: Subject to any disclaimer, the term of this patent is extended or adjusted under 35 U.S.C. 154(b) by 198 days.

(21) Appl. No.: 12/464,658

(22) Filed: May 12, 2009

(65) Prior Publication Data

US 2010/0288681 A1 Nov. 18, 2010

(51) Int. Cl.
*B07B 1/20* (2006.01)

(52) U.S. Cl. ..... 209/306; 209/273; 209/305; 210/413; 210/414

(58) Field of Classification Search ..... 209/17, 209/273, 305, 306; 210/413–415, 498, 512.1
See application file for complete search history.

(56) References Cited

U.S. PATENT DOCUMENTS

| | | | | | |
|---|---|---|---|---|---|
| 2,478,651 | A | * | 8/1949 | Blachere | 99/513 |
| 3,545,621 | A | * | 12/1970 | Lamort | 210/298 |
| 3,672,506 | A | * | 6/1972 | Syrjanen | 209/273 |
| 3,785,495 | A | * | 1/1974 | Holz | 210/210 |
| 3,786,918 | A | * | 1/1974 | Holz | 209/273 |
| 3,898,157 | A | | 8/1975 | Hooper | |
| 4,601,819 | A | * | 7/1986 | Pellhammer et al. | 209/273 |
| 4,749,474 | A | * | 6/1988 | Young | 209/273 |
| 4,913,806 | A | | 4/1990 | Hillstrom et al. | |
| 5,119,953 | A | | 6/1992 | Atkeison, III et al. | |
| 5,476,178 | A | * | 12/1995 | Lamort | 209/273 |
| 5,538,632 | A | * | 7/1996 | Gero et al. | 210/338 |
| 5,575,395 | A | | 11/1996 | Alajaaski et al. | |
| 5,622,267 | A | * | 4/1997 | Hautala | 209/273 |
| 5,707,488 | A | * | 1/1998 | Markham | 162/4 |
| 5,798,025 | A | | 8/1998 | Iwashige | |
| 5,884,774 | A | | 3/1999 | Aikawa | |
| 5,925,249 | A | * | 7/1999 | Fredriksson | 210/415 |
| 6,171,448 | B1 | * | 1/2001 | Iwashige | 162/380 |
| 6,241,102 | B1 | * | 6/2001 | Lindberg et al. | 210/414 |
| 6,550,620 | B2 | * | 4/2003 | Fukudome et al. | 209/306 |
| 6,702,120 | B1 | | 3/2004 | Forslund et al. | |
| 6,923,329 | B2 | * | 8/2005 | Aikawa | 209/273 |
| 2001/0011641 | A1 | * | 8/2001 | Fukudome et al. | 209/306 |
| 2002/0139723 | A1 | * | 10/2002 | Danger et al. | 209/273 |
| 2004/0035761 | A1 | * | 2/2004 | Rienecker et al. | 209/306 |
| 2007/0199883 | A1 | * | 8/2007 | Brettschneider et al. | 210/415 |

FOREIGN PATENT DOCUMENTS

| | | |
|---|---|---|
| SE | 348243 | 8/1972 |

* cited by examiner

*Primary Examiner* — Joseph C Rodriguez
(74) *Attorney, Agent, or Firm* — James Earl Lowe, Jr.

(57) ABSTRACT

A device including a hollow cylindrical body, first and second stationary coaxial annular screening screens disposed within the body, and a rotor within the body and positioned between the screens to conduct the slurry through the first screen and then through the second screen, the rotor being driven in rotation. The pulp slurry passes through a central entry pipe, radially outward and then upward along the inside of the rotor, further inward through a coarse screen cylinder, and then around the end of the rotor to pass between the outer surface of the rotor and the inner surface of a fine screen cylinder. The pulp slurry then finally passes outward through the fine screen cylinder. Coarse rejects, such as knots or other coarse material, are collected at the end of the coarse screening chamber and led away for further processing. Fine rejects are similarly collected at the end of the fine screening chamber, also to be led away separately for further processing.

10 Claims, 3 Drawing Sheets

TWO STAGE PULP SCREENING DEVICE WITH TWO STATIONARY CYLINDRICAL SCREENS

BACKGROUND

This disclosure relates to the separation of fiber from cellulose pulp slurry by rotary screening of the pulp stock and, more particularly, to a two stage pressure type screening device. The first stage is a coarse screen with the pulp slurry inflowing a stationary screen and rejecting the coarser particles in the pulp. This first stage is referred to as deknotting in chemical pulping applications, or as simply coarse screening in, for example, old corrugated cardboard (OCC) screening. The second stage is a fine screen to better insure the separation of the rejects from the pulp fibers. Examples of similar devices include U.S. Alajaask Pat. No. 5,575,395 and U.S. Forslund Pat. No. 6,702,120

Two stage screening devices have been known in the past, and three examples of such devices are disclosed in U.S. Hooper Pat. No. 3,898,157, granted Aug. 5, 1975; in U.S. Lamort Pat. No. 3,545,621, granted Dec. 8, 1970; and A. B. Knutsilpalater in Swedish printed Patent application 348,243, filed Feb. 7, 1970. These publications show two screen stages in line on the same vertical axis with the first stage being on top and the screens both being stationary and approximately the same diameter. The pulp slurry inflows through the first stage screen and outflows through the second stage screen. The disclosures show rotating foils within the screens to prevent the perforations or slots from plugging.

U.S. Gero et al. Pat. No. 5,538,632 illustrates a pulp washer, with two concentric, radially spaced apart inside and outside washer screens, with a rotor between the screens, with slurry passing first past the inside screen on the inside surface of the rotor, and then past the outside screen on the outside of the rotor.

SUMMARY

This application discloses a device including a hollow cylindrical body, first and second stationary coaxial annular screening screens disposed within the body, and a rotor within the body and positioned between the screens to conduct the slurry through the first screen and then through the second screen, the rotor being driven in rotation.

The pulp slurry passes through a central entry or slurry inlet pipe, radially outward and then upward along the inside of the rotor, further inward through a coarse screen cylinder, and then around the end of the rotor to pass between the outer surface of the rotor and the inner surface of a fine screen cylinder. The pulp slurry then finally passes outward through the fine screen cylinder. Coarse rejects, such as knots or other coarse material, are collected at the end of the coarse screening chamber and led away for further processing. Fine rejects are similarly collected at the end of the fine screening chamber, also to be led away separately for further processing.

One of the principal objects of the disclosure is to provide both coarse and fine screening in a compact container.

Another of the principal objects of the disclosure is to provide both coarse and fine screening making use of a single rotor to provide the motive force to screen both knots and shives or other small debris from a pulp carrying slurry.

Figure 1:
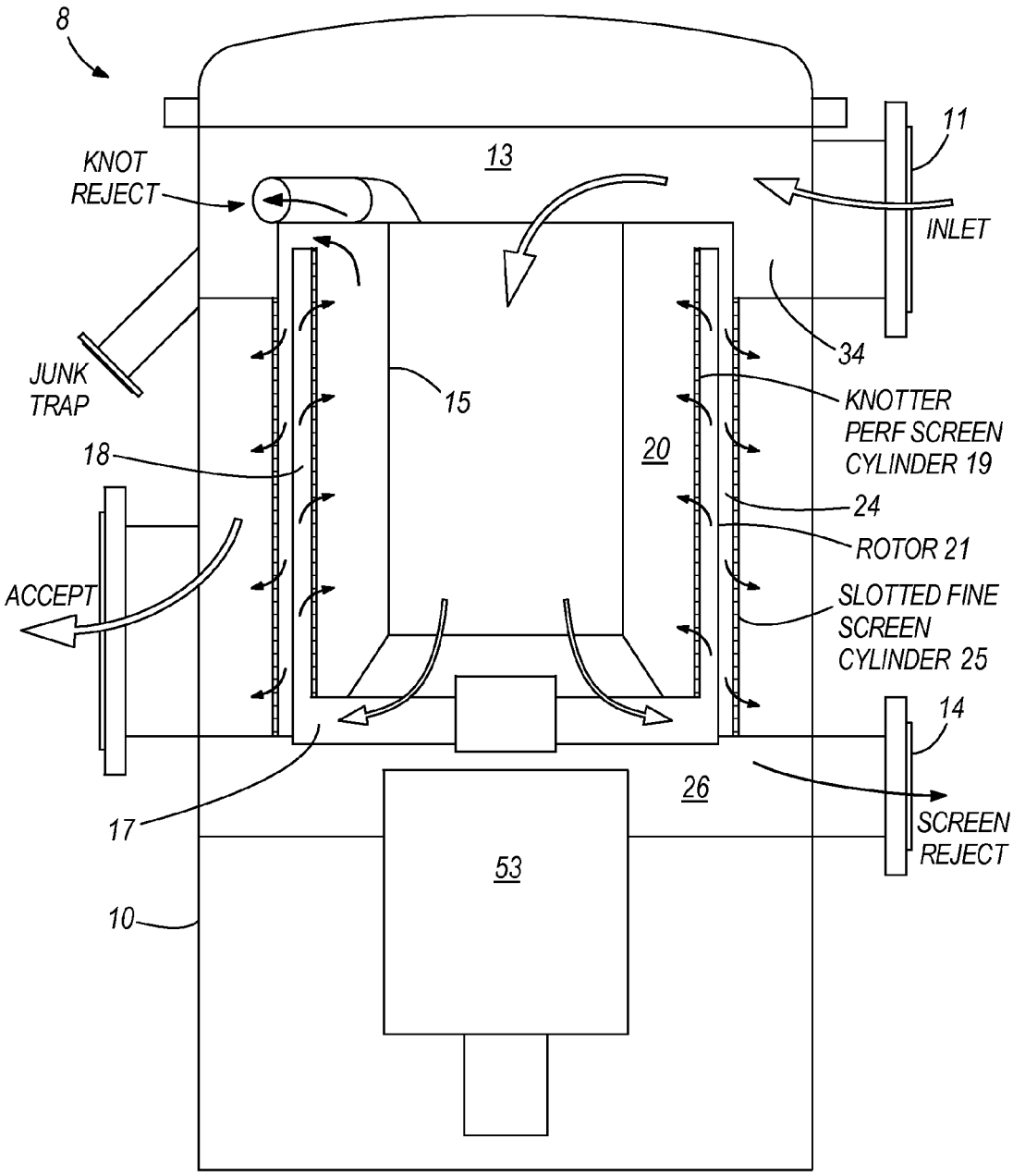
FIG. 1 is a vertical sectional view taken through the axis of a pulp-screening device.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience in reference to the drawings and are not to be construed as limiting terms.

DETAILED DESCRIPTION OF THE PREFERRED EMBODIMENT

Illustrated in FIG. 1 of the drawings is a preferred embodiment of a pulp-screening device 8. The device 8 includes a hollow cylindrical body or housing 10, first and second stationary coaxial annular screening screens 19 and 25 disposed within the housing 10, with the second screen 25 disposed generally radially outwardly of the first screen 19, and a rotor 21 within the housing 10 and positioned between the screens 19 and 25 to conduct the slurry through the first screen 19 and then through the second screen 25, the rotor 21 being driven in rotation.

More particularly, the annular housing 10 has an inlet chamber 13 therein for receiving a flow of stock slurry that is admitted at an inlet 11 into the housing 10. Arrowed lines are included on the drawing to show the flow of stock and fiber knots through the housing as the stock proceeds through the housing. The screened slurry passes out of the housing 10 through an accepts outlet 12.

The first and second screens 19 and 25, respectively, are mounted within the housing. The screens 19 and 25 are annular, foraminous bodies, coaxially positioned, with screen 19 being disposed radially within, but spaced from screen 25.

As the stock slurry enters the housing at 11, it flows in a circumferential manner, with large junk pieces settling under the force of gravity in a junk trap in a lower most portion of the inlet chamber 13. Although normally closed, the junk trap can be opened to remove the junk pieces, when desired. The slurry then flows like a vortex to the center of the inlet chamber 13, with the velocity increasing in inverse proportion to the radius (similar to a hydro cyclone). The slurry then travels axially downward along a stationary slurry inlet pipe 15 to an open chamber 17, where it is directed radially outwardly to flow in an opposite axial upward direction through an annular passage 18. In the annular passage 18, the slurry flows past the openings of the first screen 19. The accepted slurry flows from the first or outer side of the screen 19 to the second or inner side of the screen 19 and into a chamber 20 between the vertical inlet pipe 15 and the screen 19.

The radial outer boundary or wall of the annular passage 18 is formed by the inside surface 57 of the annular rotor 21, which is coaxial with the annular screen 19 and is mounted on a rotor support 22. The rotor support 22 is driven in rotation by a drive motor 53.

The rotor 21 is a cylinder, open at the top and closed at the bottom. The rotational velocity of the stock when it first reaches the rotor 21 will be on the same order of magnitude as the rotor 21. In the preferred embodiment, the radial gap between the inside of the rotor 21 and the outside of the coarse screen 19 is 50 mm, although other dimensions can be used in other embodiments. The rotor need only maintain the stock velocity relative to the screen 19, so some degree of roughness may be necessary. In the preferred embodiment, the inside surface of the rotor 21 is smooth, but it may have a profiled surface or surfaces to transfer rotational acceleration to the stock. Further, if some sort of face cleaning pulsation is needed, that can also be added to the inside surface of the rotor 21, in a conventional manner.

Figure 2:
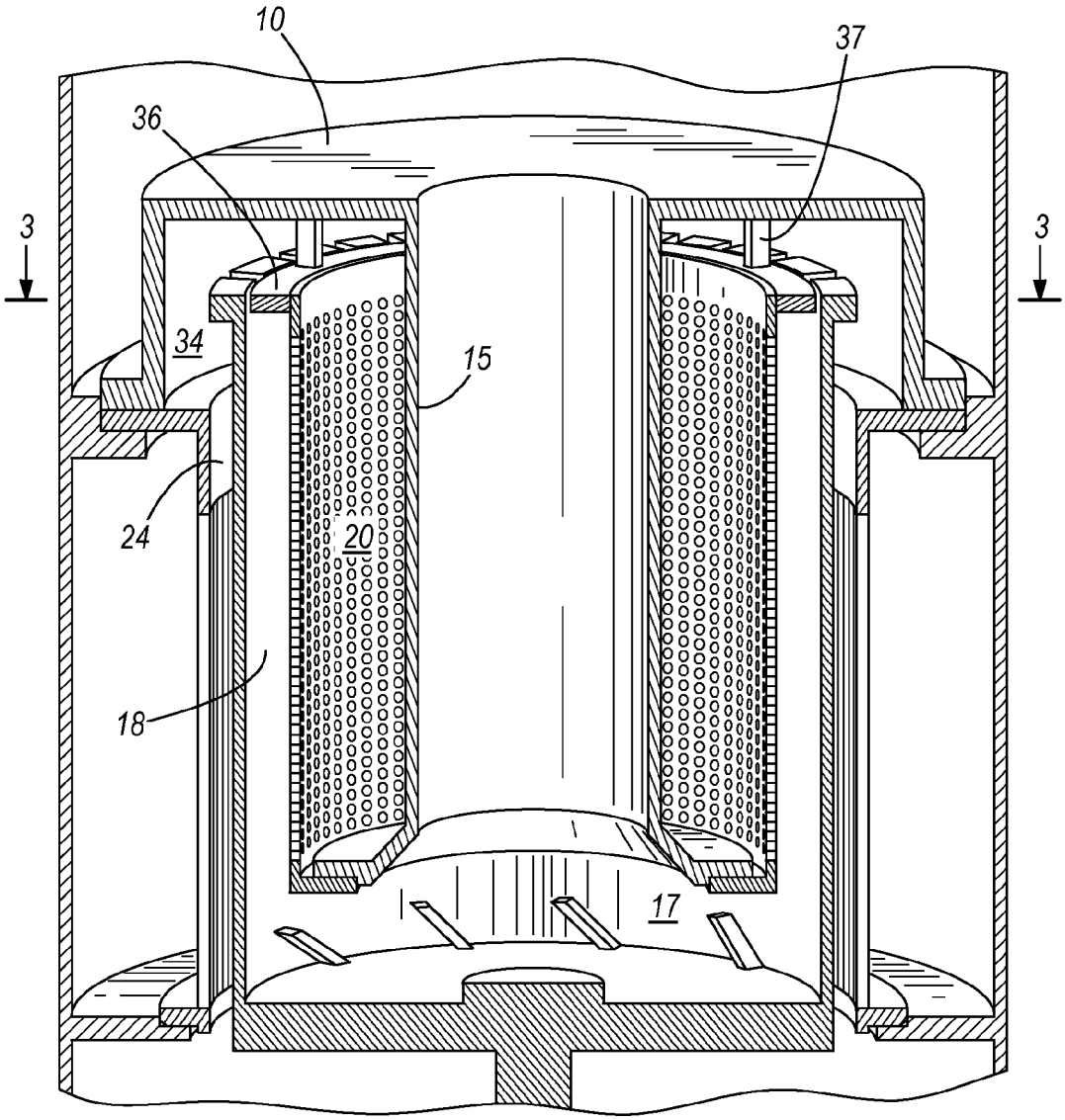
FIG. 2 is a vertical sectional perspective view of the pulp-screening device shown in FIG. 1.
Figure 3:
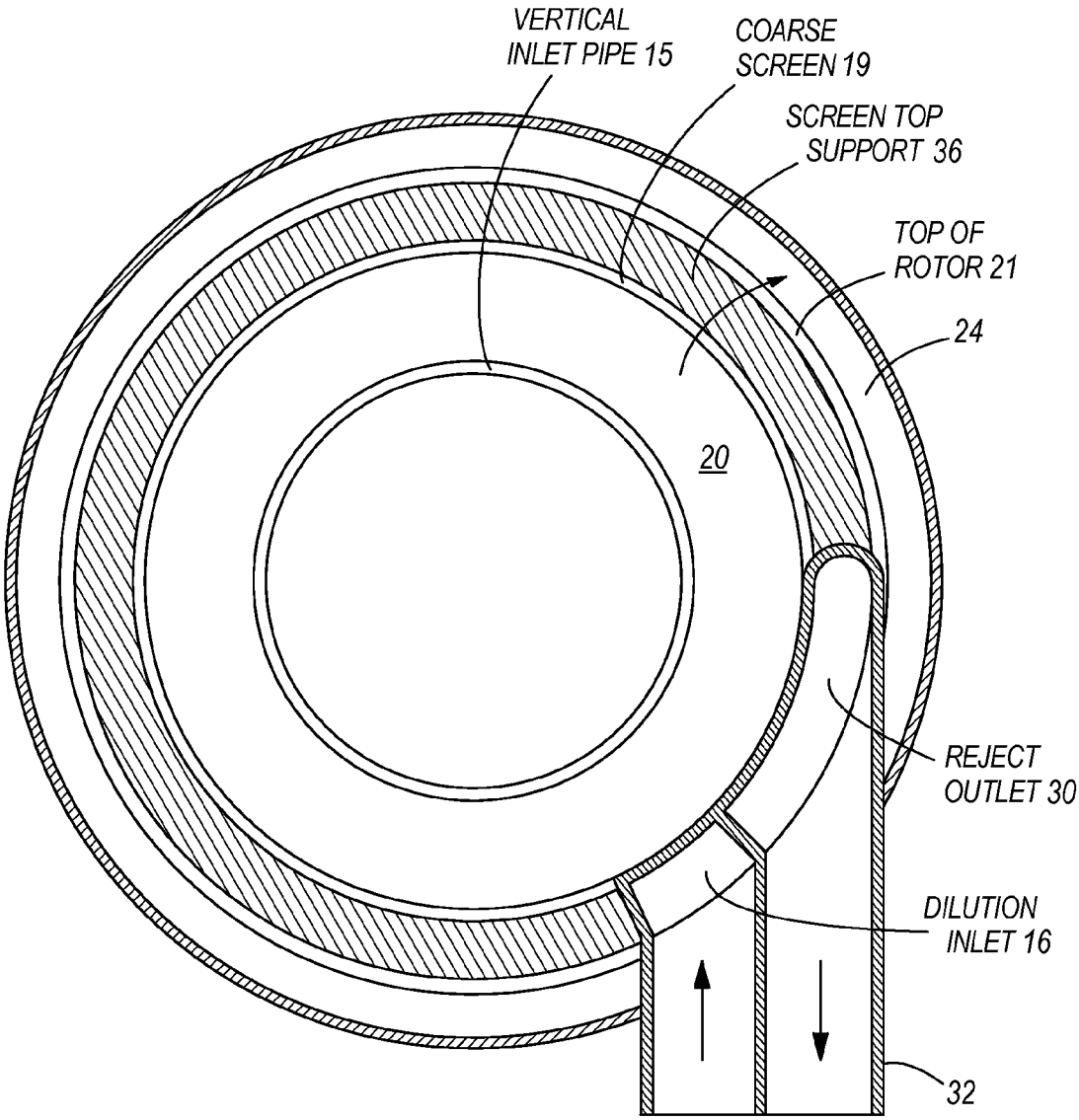
FIG. 3 is top view of the pulp-screening device shown in FIG. 2 taken along the line 3-3 in FIG. 2.

As the slurry flows axially along the screen 19 and the rotor 21, the flow being to the top as shown in FIGS. 1 and 2, the slurry reaches the top of the rotor 21. Closing the end of the annular passage 18 between the first screen 19 and the rotor 21, adjacent the open end of the rotor 21, as shown in FIGS. 2 and 3, is a screen top support 36. The screen top support 36 is in the form of a ring, spaced apart from the top of the housing 10 by spaced apart legs 37 (see FIG. 2). The screen top support 36 closes the end of the passage 18, except for a rejects outlet 30, and a dilution inlet 16.

Dilution liquid is added through the dilution liquid inlet 16. The dilution liquid mixes with the fibers and aids in replacing liquor withdrawn from the fibers in its passage along the axial passage 18. Knots rejected by the screen 19 continue to the top of the annular passage 18, where they exit vertically (see FIG. 3) through the rejects outlet, which is in the form of a small chamber 30 the width of the distance (~50 mm) between the rotor 21 and the screen and about 10% of the circumference of the screen tip support 36 in arc length. This small chamber 30 communicates with a pipe 32 leading radially out of the housing 10.

As shown in FIG. 3, the stock accepted through the knotter screen 19 goes upward, and then passes radially through a gap 34 (~100 mm high) over the top of the annular passageway 18 and the screen top support (see FIGS. 2 and 3), and then downward between the rotor 21 and the fine slotted screen 25.

The slurry then leaves the gap 34 and reverses flow direction, as shown by the arrowed line in FIG. 1. The slurry then flows axially in an opposite direction along an annular, axially extending passage 24. The passage 24 is defined between the outer surface of the rotor 21 and the annular screen 25. The slurry flows through the screen 25, leaving behind any debris or fine contaminants still remaining in the slurry, that then flow into an outlet chamber 26 and out of the device 8 through a reject pipe 14. The rotor 21, driven in rotation, generates circumferential and radial velocities in the stock, and an axial velocity is generated by the pressure differential between the inlet 11 and the accepts outlet 12.

The rotor rotation generates negative pulsations and mixing of the slurry along the screen surface. To aid in this, a plurality of projections (not shown) are mounted on the outer radial surfaces of the rotor 21. These projections may take various desired shapes, but in the preferred embodiment, are in a smoothed form of the shape of the rotor 123 shown in FIG. 3 of U.S. Young et al. Pat. No. 5,307,939, which is incorporated herein by reference.

As shown and described in this embodiment, the device 8 occupies relatively little space, and the stock slurry makes two full axial passages through the housing 10 and is subjected to two full length axial travels through the screens 19 and 25.

Various other features and advantages of the invention will be apparent from the following claims.

The invention claimed is:

1. A device including a hollow body defining axially extending compartments therein for receiving a slurry of pulp fibers in a carrying slurry and provided with a slurry inlet and a slurry outlet; first and second stationary coaxial annular screening screens disposed within said body; with the second screen disposed generally radially outwardly of the first screen, a rotor within the body and positioned between the screens to conduct the slurry through said first screen and then through said second screen, said rotor being driven in rotation, and a pipe coaxial with and radially inward from said first screen, said rotor being closed at one end and open at the other end, so that slurry passing through said first screen passes axially along said housing, between said pipe and the first screen, and then around said rotor at its open end to pass axially along said housing between the outer surface of the rotor and the second screen.

2. A device in accordance with claim 1, wherein said pipe is a slurry inlet pipe.

3. A device in accordance with claim 1 wherein said device at said rotor open end includes a rejects outlet so that slurry not passing through said first screen exits said body through said rejects outlet.

4. A device in accordance with claim 3 wherein said device at said rotor open end includes a dilution liquid inlet adjacent said rejects outlet so that dilution liquid is added to the slurry not passing through said first screen after rejects exit through said rejects outlet.

5. A device including a hollow cylindrical body defining axially extending compartments therein for receiving a slurry of pulp fibers in a carrying slurry and provided with a slurry inlet and a slurry outlet; first and second stationary coaxial annular screens disposed within said body; with the second screen disposed generally radially outwardly of the first screen, a pipe radially inward from said first screen, and a rotor having a first side and a second side, said rotor being within the body and positioned between the screens to conduct the slurry along the rotor first side and through said first screen and then along the rotor second side and through said second screen, said rotor being driven in rotation, wherein slurry passing through said first screen passes axially along said housing, between said pipe and the first screen, and then around an end of the rotor to pass axially along said housing between the outer surface of the rotor and the second screen.

6. A device in accordance with claim 5, wherein said pipe is a slurry inlet pipe.

7. A device in accordance with claim 5, wherein said rotor is closed at one end and open at the other end, so that slurry passing through said first screen passes axially along said housing, between said pipe and the first screen, and then around said rotor at its open end to pass axially along said housing between the outer surface of the rotor and the second screen.

8. A device in accordance with claim 7 wherein said device at said rotor open end includes a rejects outlet so that slurry not passing through said first screen exits said cylindrical body through said rejects outlet.

9. A device in accordance with claim 8 wherein said device at said rotor open end includes a dilution liquid inlet adjacent said rejects outlet so that dilution liquid is added to the slurry not passing through said first screen after rejects exit through said rejects outlet.

10. A device in accordance with claim 9, wherein said pipe is a slurry inlet pipe.

* * * * *